US008328059B2

(12) United States Patent
Tanaka

(10) Patent No.: US 8,328,059 B2
(45) Date of Patent: Dec. 11, 2012

(54) GAS COMBUSTION TYPE DRIVING TOOL

(75) Inventor: Hiroshi Tanaka, Chuo-ku (JP)

(73) Assignee: Max Co., Ltd., Tokyo (JP)

( * ) Notice: Subject to any disclaimer, the term of this patent is extended or adjusted under 35 U.S.C. 154(b) by 71 days.

(21) Appl. No.: 12/666,933

(22) PCT Filed: Jun. 24, 2008

(86) PCT No.: PCT/JP2008/061491

§ 371 (c)(1),
(2), (4) Date: Dec. 28, 2009

(87) PCT Pub. No.: WO2009/004955

PCT Pub. Date: Jan. 8, 2009

(65) Prior Publication Data

US 2010/0140315 A1 Jun. 10, 2010

(30) Foreign Application Priority Data

Jun. 29, 2007 (JP) ..... 2007-171659

(51) Int. Cl.
*B25C 1/08* (2006.01)

(52) U.S. Cl. ..... 227/10; 227/9

(58) Field of Classification Search ..... 227/8–11, 227/130; 123/46 SC, 46 R, 48 R
See application file for complete search history.

(56) References Cited

U.S. PATENT DOCUMENTS

| | | | | |
|---|---|---|---|---|
| 4,483,473 | A * | 11/1984 | Wagdy | 227/8 |
| 4,483,474 | A * | 11/1984 | Nikolich | 227/8 |
| 5,090,606 | A * | 2/1992 | Torii et al. | 227/10 |
| 5,191,861 | A * | 3/1993 | Kellerman et al. | 123/46 SC |
| 5,199,626 | A * | 4/1993 | Terayama et al. | 227/10 |
| 5,320,268 | A | 6/1994 | Shkolnikov et al. | |
| 5,687,899 | A * | 11/1997 | Dohi et al. | 227/10 |
| 6,755,159 | B1 | 6/2004 | Adams et al. | |
| 7,044,090 | B2 * | 5/2006 | Ohtsu et al. | 123/46 SC |
| 7,118,018 | B2 * | 10/2006 | Turk | 227/10 |
| 7,194,988 | B2 * | 3/2007 | Ohmori et al. | 123/48 R |
| 7,458,493 | B2 * | 12/2008 | Nishikawa et al. | 227/10 |
| 7,931,181 | B2 * | 4/2011 | Akiba | 227/10 |
| 2005/0035171 | A1 * | 2/2005 | Ohtsu et al. | 227/8 |
| 2005/0229598 | A1 * | 10/2005 | Akiba et al. | 60/632 |

FOREIGN PATENT DOCUMENTS

| | | |
|---|---|---|
| EP | 0 056 990 A2 | 8/1982 |
| JP | 4-48589 | 8/1992 |
| JP | 7-1363 A | 1/1995 |
| JP | 2001-162560 | 6/2001 |
| JP | 2004-223709 A | 8/2004 |
| JP | 2005-46977 | 2/2005 |
| JP | 2005-59137 | 3/2005 |
| JP | 2005-329533 | 12/2005 |

* cited by examiner

*Primary Examiner* — Lindsay Low
*Assistant Examiner* — Andrew M Tecco
(74) *Attorney, Agent, or Firm* — Drinker Biddle & Reath LLP

(57) ABSTRACT

A gas combustion type driving tool (A) has a cylinder (4) for slidably receiving a piston (5), a cylinder head (8) provided above the cylinder (4), a tubular movable sleeve (15) movably placed in a vertical gap between the cylinder (4) and the cylinder head (8), and an annular sliding section (17) formed below the upper opening end of the cylinder (4) and sliding against an opening section at the lower end of the movable sleeve (15).

5 Claims, 3 Drawing Sheets

GAS COMBUSTION TYPE DRIVING TOOL

TECHNICAL FIELD

The present invention relates to an improved structure of a combustion chamber for a gas combustion type driving tool.

BACKGROUND ART

Generally, a gas combustion type driving tool is provide with a cylindrical movable sleeve in an upper part of a cylinder, as described in patent documents 1 and 2. When the movable sleeve is closed so that a combustion chamber becomes in a tightly closed state, a combustible gas and a fresh air are supplied into an inside of the combustion chamber. After the combustible gas and the air are agitated and mixed by the rotation of a fan, a mixed gas is ignited and explosively burned. A high gas pressure acts on a piston to drive a fastener. After an end of a driving operation, the combustion chamber is opened to exhaust the combustion gas, whereby a next driving operation is prepared.

Patent document 1: JP-B-04-048589

Patent document 2: JP-A-2001-162560

The movable sleeve is disposed on an upper portion of the cylinder. By moving this movable sleeve upward or downward, the combustion chamber is opened and closed. That is, when the movable sleeve is moved upward, it comes into contact with an upper seal part and a lower seal part provided on an outer circumferential surface of a cylinder head provided above the cylinder and the outer circumferential surface at the upper end of the cylinder, so that the combustion chamber is placed in a tightly closed state, as described in patent documents 1 and 2. When the movable sleeve is moved downward, the seal with the upper and lower seal parts is released so that the combustion chamber is placed in an open state.

In this manner, in a structure in which the cylinder and the movable sleeve are disposed in series in a vertical direction, it is required a space for disposing the movable sleeve on an upper portion of the cylinder, and it is also required a space for moving the movable sleeve upward or downward on an upper side of the movable sleeve. Therefore, the total height of the driving tool is increased, thereby making a tool size larger.

However, the driving tool with great total height has a problem that the tool is not only heavy and tiring, but also less convenient during carrying out a corner driving operation or an oblique driving operation because the upper part is an obstacle.

On the contrary, if the height of the movable sleeve is reduced, the total height is reduced, but a volume of the combustion chamber is smaller to make the combustion energy smaller and a driving capability lower. Besides, though there is a possible solution for increasing the diameter of the movable sleeve to suppress the height of the combustion chamber, the body of the driving tool is thickened even though the total height can be suppressed, whereby the tool is difficult to handle and is unsuitable for carrying out the corner driving operation.

SUMMARY OF INVENTION

One or more embodiments of the invention relate to a gas combustion type driving tool that can realize a small size by reducing a total height while securing a predetermined volume in a combustion chamber, with a basic arrangement structure maintained, and have a sufficient driving capability without impairing a usability in carrying out a corner driving operation.

In accordance with a first aspect of the invention, in a gas combustion type driving tool, a cylinder head is provided above a cylinder for slidably accommodating a piston, a cylindrical movable sleeve is disposed movably between the cylinder and the cylinder head, and a combustion chamber formed inside the movable sleeve is opened and closed by moving the movable sleeve, a mixed gas is ignited and burned in a tightly closed state of the combustion chamber, an exhaust and a suction are performed in an open state of the combustion chamber, an inner diameter of the movable sleeve is larger than an outer diameter of the cylinder, a lower end of the movable sleeve extends below an upper open end of the cylinder, and an annular sliding portion for sliding with an opening portion at a lower end of the movable sleeve is formed on an outer circumference of the cylinder and below an upper opening end of the cylinder.

In accordance with a second aspect of the invention, in the gas combustion type driving tool of the first aspect, the sliding portion is formed below a top dead center of the piston.

In accordance with a third aspect of the invention, in the gas combustion type driving tool of the first or second aspect, a cylindrical partition wall portion is provided on an extension from an upper end of the cylinder, and an opening portion is formed on each of an upper part and a lower part of the partition wall portion.

According to the first aspect, the movable sleeve is larger in diameter than the cylinder, with the lower end of the movable sleeve extending below the upper open end of the cylinder, and the annular sliding portion for sliding with the opening portion at the lower end of the movable sleeve is formed on the outer circumference of the cylinder and below the upper opening end, whereby the combustion chamber is formed not only on an upper portion of the cylinder but also extends around the cylinder. The height of the movable sleeve can be reduced by an increased volume around the cylinder. Accordingly, it is possible to provide a gas combustion type driving tool that can reduce the total height while securing a predetermined volume in the combustion chamber with a basic arrangement structure maintained, and have a sufficient driving capability without impairing the usability in carrying out the corner driving operation.

According to the second aspect, since the sliding portion of the cylinder is formed below the top dead center of the piston slidably accommodated in the cylinder, it is possible to extend the combustion chamber around the cylinder and reduce the height of the movable sleeve by an increased volume around the cylinder as in the first aspect.

According to the third aspect, since the cylindrical partition wall portion is provided on the extension from the upper end of the cylinder, and the opening portion is formed on each of the upper part and the lower part of the partition wall portion, a flow path leading from the central part of the combustion chamber through the lower opening portion to a lower portion of the combustion chamber outside the partition wall portion and further from a lower portion to an upper portion of the combustion chamber outside, from an upper portion of the combustion chamber outside through the upper opening portion to the central part of the combustion chamber is formed inside the combustion chamber. Therefore, when the fuel gas and the air supplied into the combustion chamber are agitated and mixed, the mixed gas flows smoothly along the flow path without residing, whereby the agitation and mixture efficiency is excellent to burn the mixed gas securely.

Other aspects and advantages of the invention will be apparent from the following description, the drawings and the claims.

DESCRIPTION OF REFERENCE NUMERALS AND SIGNS

Figure 1:
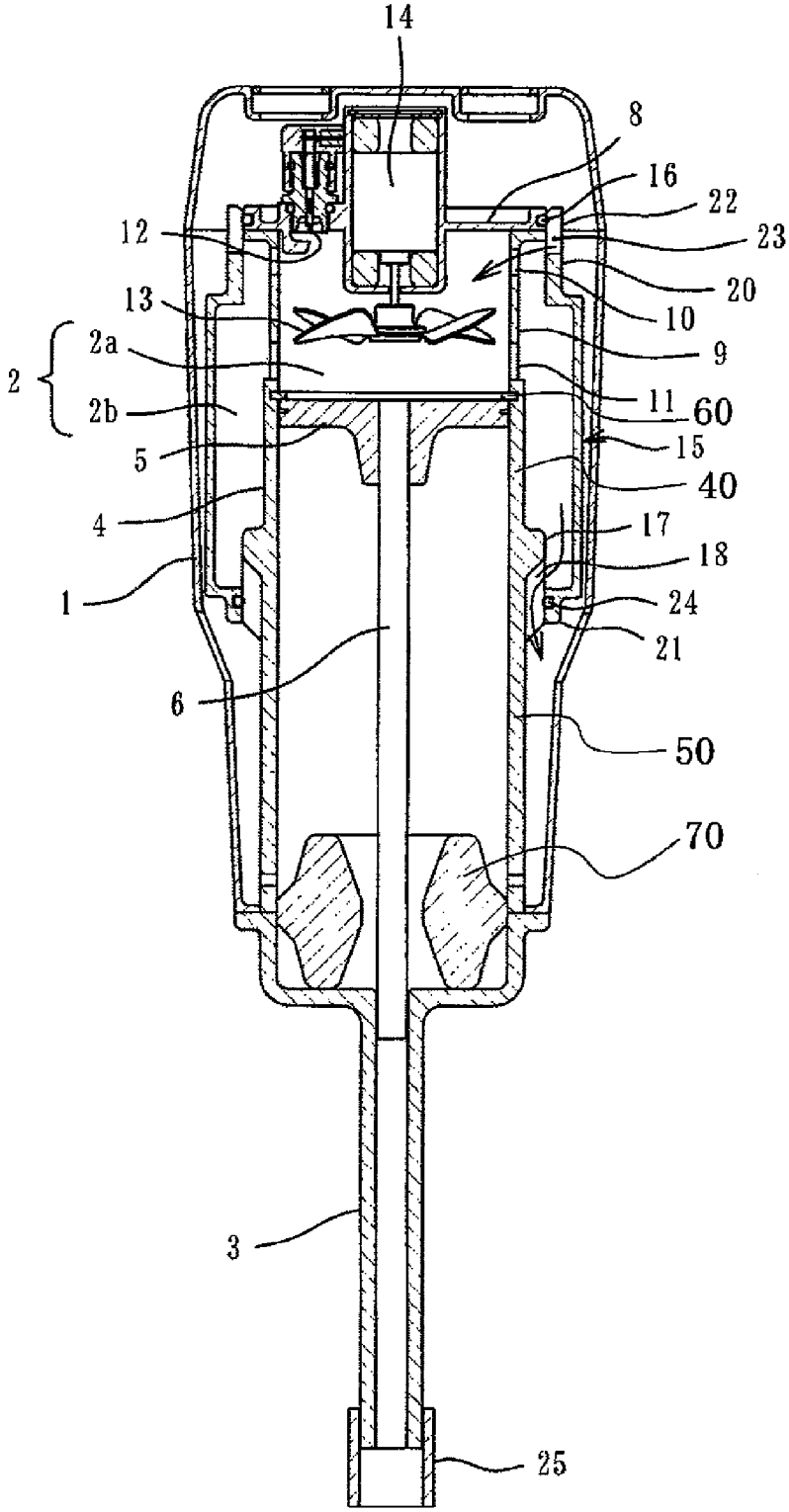
FIG. 1 is a longitudinal cross-sectional view showing an essence of a gas combustion type nailing machine according to an exemplary embodiment of the present invention in a state where a combustion chamber is opened.

A gas combustion type driving tool
2 combustion chamber
4 cylinder
5 piston
15 movable sleeve
17 sliding portion (second outer circumferential portion)
40 first outer circumferential portion
50 third outer circumferential portion
60 stopper
70 bumper

DESCRIPTION OF EMBODIMENTS

A nailing machine will be described as an exemplary embodiment of a gas combustion type driving tool according to the present invention.

Figure 2:
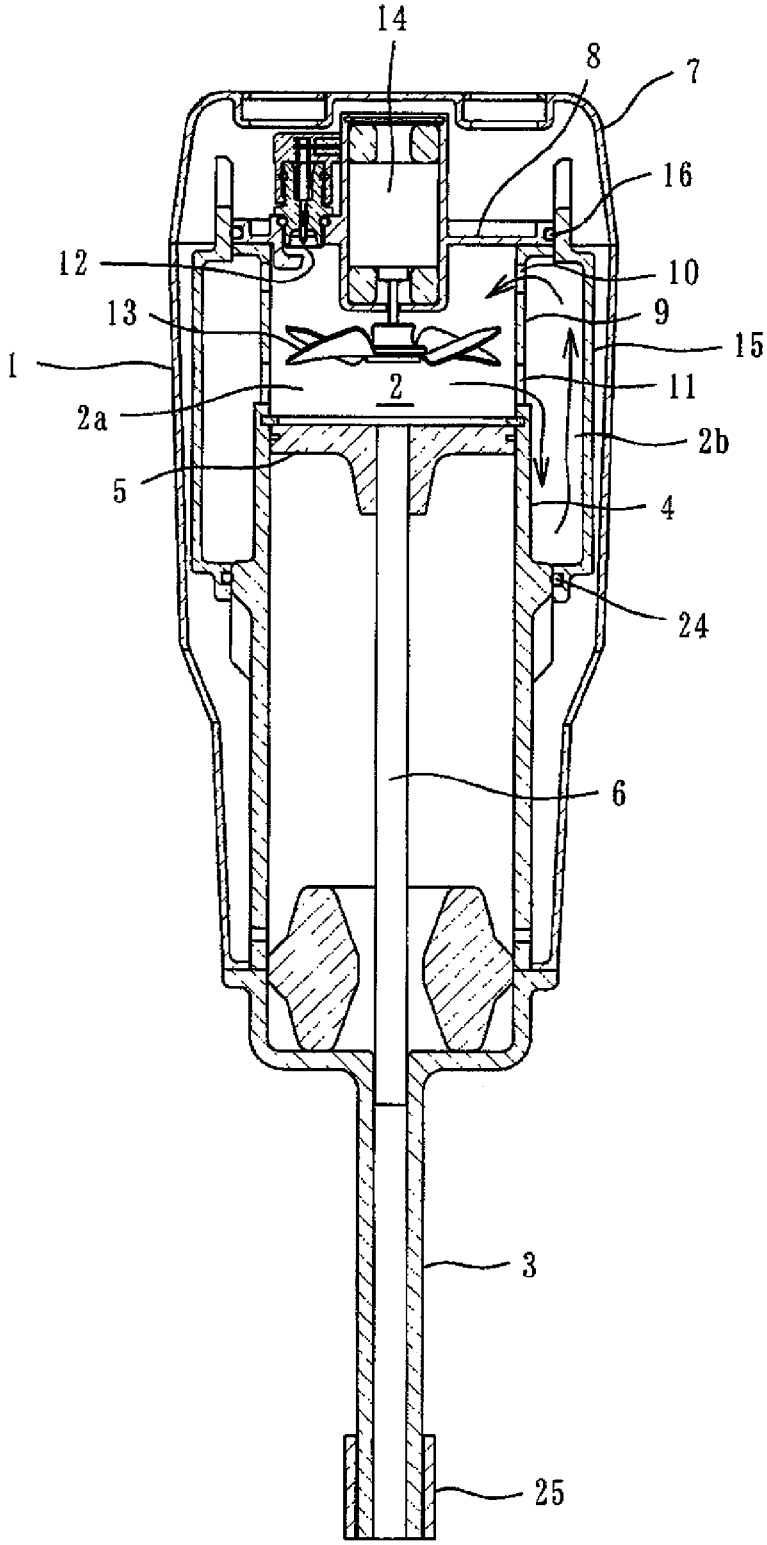
FIG. 2 is a longitudinal cross-sectional view showing a state where the combustion chamber is tightly closed in hammering a nail.

In FIGS. 1 and 2, reference numeral 1 denotes a tool main body of the gas combustion type driving tool (nailing machine). A grip and a magazine (not shown) are connected to this tool main body 1, and a combustion chamber 2 and a piston cylinder mechanism are provided internally. A nose portion 3 for delivering a nail is provided in a lower portion of the tool main body 1.

In the piston cylinder mechanism, a piston 5 is slidably accommodated in a cylinder 4, and a driver 6 is integrally connected in a lower side of the piston 5.

A stopper 60 is provided on an inner circumferential surface of an upper opening end of the cylinder 4. An upward movement of the piston 5 is regulated by the stopper 60. Also, a bumper 70 is provided on a lower portion of the cylinder 4. A downward movement of the piston 5 is regulated by the bumper 70. That is, a lower surface of the stopper 60 corresponds to a top dead center of the piston 5 and an upper surface of the bumper 70 corresponds to a bottom dead center of the piston 5.

By the way, a cylindrical partition wall portion 9 is provided on an extension from an upper part of the cylinder 4, and an upper end of the partition wall portion 9 is butt joined with a lower surface of a cylinder head portion 8 formed inside an upper housing 7 of the tool main body 1. Also, the opening portions 10 and 11 are formed on the upper part and the lower part the partition wall portion 9, respectively.

The cylinder head portion 8 is provided with an ignition plug 12 and a rotating fan 13. The ignition plug 12 ignites and burns a mixed gas of fuel gas and air within the combustion chamber 2. Also, the rotating fan 13 agitates and mixes the fuel gas and the air, and is disposed in a center of the partition wall portion 9, in which a gap between the tip of the rotating fan 13 and the partition wall portion 9 is formed to be smaller, and a position of the rotating fan 13 is between an upper opening portion 10 and a lower opening portion 11 of the partition wall portion 9. Reference numeral 14 denotes a drive motor for the rotating fan 13. Also, an exhaust nozzle of fuel gas, not shown, connecting to a gas container is opened in the cylinder head portion 8.

Further, a movable sleeve 15 making up the combustion chamber 2 is disposed above the cylinder 4. The movable sleeve 15 is formed cylindrically, and disposed slidably in a vertical direction between the cylinder 4 and the cylinder head portion 8 formed inside the upper housing 7. When the movable sleeve is moved downward as shown in FIG. 1, the combustion chamber 2 constructed inside the movable sleeve 15 is opened, and when it is moved upward as shown in FIG. 2, the tightly closed combustion chamber 2 is formed inside the movable sleeve 15.

That is, the fringe of the cylinder head portion 8 is formed circularly, and an upper O-ring 16 is provided on the outer fringe. Also, an annular sliding portion 17 is formed to swell out on the outer circumference of an intermediate part of the cylinder 4, and an opening groove 18 is cut out with a fixed interval on a lower portion of the outer circumferential surface of the annular sliding portion 17. The annular sliding portion 17 is formed at least under the top dead center of the piston 5.

The outer circumference of the cylinder 4 has a first outer circumferential portion 40 disposed at the height position corresponding to the top dead center of the piston 5, a second outer circumferential portion located below the first outer circumferential portion 40, and a third outer circumferential portion 50 located below the second outer circumferential portion. The sliding portion 17 corresponds to the second outer circumferential portion. The outer diameter of the second outer circumferential portion is larger than the outer diameter of the first outer circumferential portion 40, and the outer diameter of the second outer circumferential portion is larger than the outer diameter of the third outer circumferential portion 50.

The movable sleeve 15 is a cylindrical member that swells out in the intermediate part, and formed in larger diameter than the cylinder 4, with its lower end extending below the upper opening end of the cylinder 4. The small diameter portions 20 and 21 are formed on the upper and lower parts of the movable through the opening groove 18 in the sliding portion of the cylinder 4 to the outside. On the contrary, when the movable sleeve 15 is moved upward as shown in FIG. 2, the combustion chamber 2 is sealed by the upper O-ring 16 and the lower O-ring 24 and tightly closed.

Also, a combustion chamber 2*a* in the center and a combustion chamber 2*b* outside the partition wall portion 9 are constituted by the partition wall portion 9.

The movable sleeve 15 is linked via a link member, not shown, to a contact member 25 provided slidably at the tip of the nose portion 3. The contact member 25 is urged by a spring to protrude from the tip of the nose portion 3. Accordingly, if the nose portion 3 is pushed against a driven workpiece, the contact member 25 is pushed in and moved upward, and the movable sleeve 15 is also moved upward via the link member, so that the tightly closed combustion chamber 2 is constituted as shown in FIG. 2. Conversely, if the nose portion 3 is detached from the driven workpiece, the contact member 25 is moved to the original position, and the movable sleeve 15 is also moved downward, so that the combustion chamber 2 is opened.

Next, an operation mode of the nailing machine having the above constitution will be described below. First of all, during a driving operation of a nail, if the nose portion 3 is strongly pushed against the driven workpiece and moved upwards relative to the tool main body 1, the movable sleeve 15 is moved upward together with the contact member 25 synchronously with it, so that the combustion chamber 2 is tightly closed by the upper O-ring 16 provided in the cylinder head portion 8 and the lower O-ring 24 provided on the outer circumference of the upper end of the cylinder 4, as shown in FIG. 2. A combustible gas is jetted out of the exhaust nozzle into the combustion chamber 2, and after the rotating fan 13 is rotated by the motor 14 to agitate and mix the combustible gas and the air, the gas is ignited and explosively burned with the ignition plug 12 by pulling a trigger. Thereby, the piston 5 is driven and the nail supplied into the nose portion 3 is delivered.

On the contrary, after an end of the driving operation, the piston 5 returns, and further the contact arm is left away from the driven workpiece to move the movable sleeve 15 downward, as shown in FIG. 1, so that the seal with the upper O-ring 16 and the lower O-ring 24 is released to open the combustion chamber 2, whereby the fresh air enters through the upper opening groove 23, and the combustion gas is exhausted through the lower opening groove 18, preparing for the next driving operation.

Figure 3:
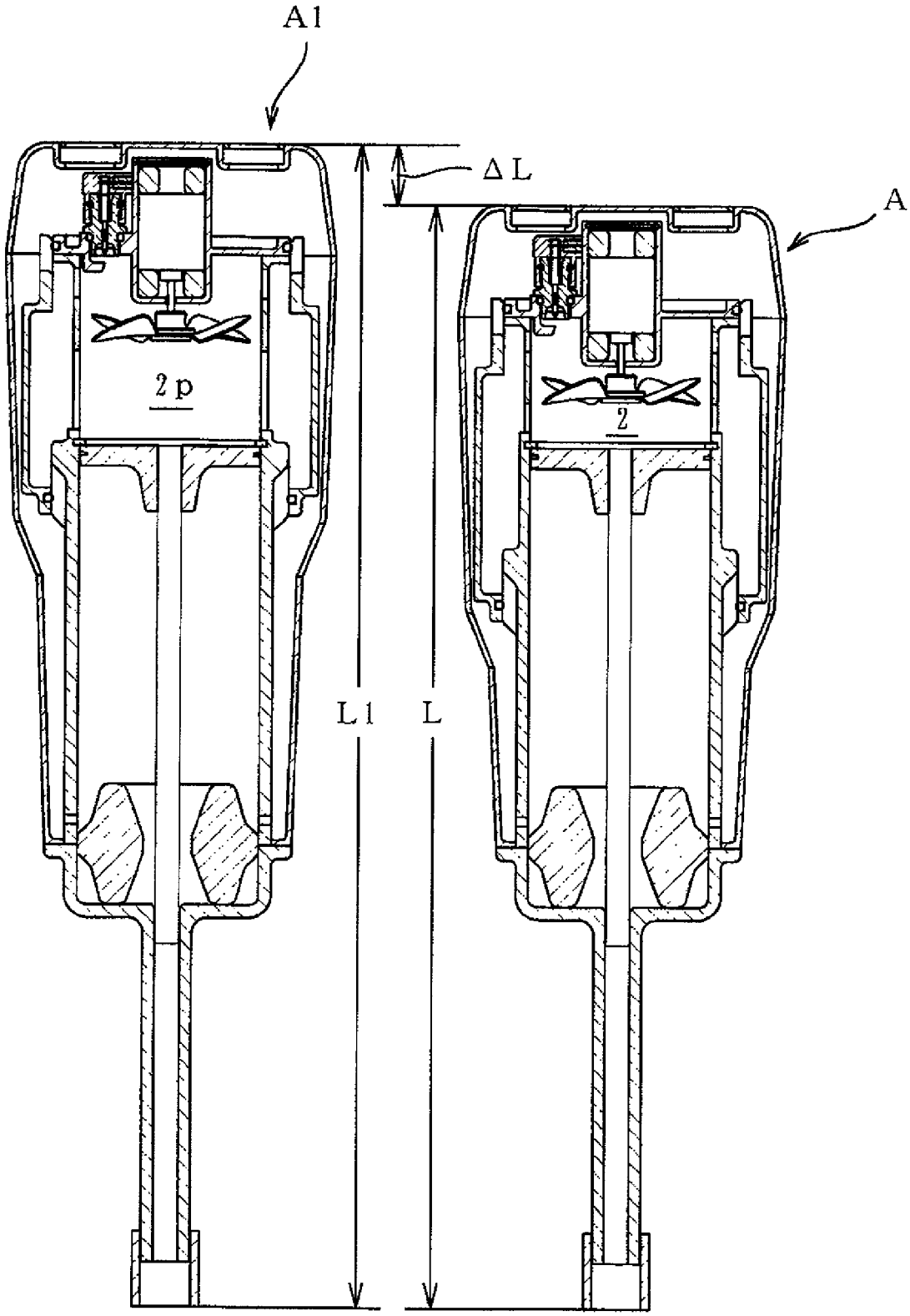
FIG. 3 shows the nailing machine A on a right side and the nailing machine A1 in the related art (not prior art) of the invention on a left side.

As described above, the movable sleeve 15 has a larger diameter than the cylinder 4, with its lower end extending below the upper open end of the cylinder 4, and the cylinder 4 is formed with the sliding portion 17 sliding with the opening portion at the lower end of the movable sleeve 15 below the upper open end, whereby the combustion chamber 2 is not only formed in the upper portion of the cylinder 4 but also extends around the cylinder 4. The height of the movable sleeve 15 can be reduced by an increased volume around the cylinder 4. Accordingly, a basic arrangement structure of the combustion chamber is maintained as compared with a combustion chamber 2*p* of a nailing machine A1 in a related art of the present application that is not prior art, as shown in FIG. 3, whereby it is possible to make a total height L smaller than a total height L1 of the nailing machine A1 while securing a predetermined volume as large as the combustion chamber 2*p* of the nailing machine A1 in the related art. Accordingly, the nailing machine has a smaller size and a lighter weight, and is easier to handle and more suitable for the minute work such as a corner driving operation, without changing the combustion energy, whereby the sufficient driving capability is obtained.

More specifically, the sliding portion 17 is desirably located at the height position between the bottom dead center and the top dead center of the piston 5, and below the top dead center by 20% or more of the total stroke between the bottom dead center and the top dead center (i.e., when the position of the bottom dead center of the piston 5 is 0 and the position of the top dead center of the piston is 100, the sliding portion 17 is desirably located below 80.) If the sliding portion 17 is located at such position, the total length L of the nailing machine A can be effectively reduced.

Also, since the cylindrical partition wall portion 9 is provided on the extension from the upper end of the cylinder 4, and the opening portions 20 and 21 are formed in the upper part and the lower part of the partition wall portion 9, respectively, a flow path leading from a central part 2*a* of the combustion chamber 2 through the lower opening portion 21 to the lower portion of the combustion chamber 2*b* outside the partition wall portion 9, further from the lower portion to the upper portion of the combustion chamber 2*b* outside, and from the upper portion of the combustion chamber 2*a* outside through the upper opening portion 20 to the central part of the combustion chamber 2 is formed inside the combustion chamber 2, as indicated by the arrow. Therefore, when the fuel gas and the air supplied into the combustion chamber 2 are agitated and mixed by the rotating fan 13 in the center of the combustion chamber 2, the mixed gas can flow smoothly along the above flow path without residing, whereby the agitating and mixing efficiency is excellent, and accordingly the mixed gas can be securely burned.

Though the combustion chamber is opened or closed by moving the movable sleeve upward or downward in this embodiment, the combustion chamber maybe opened or closed between the combustion chamber and the movable sleeve by rotating the movable sleeve.

Also, though the cylindrical partition wall portion is provided on the extension from the upper end of the cylinder, the cylinder and the cylinder head portion may be fixed on the housing without providing the partition wall portion.

Also, means for mixing the fuel gas and the air is not limited to the fan.

Though the present invention has been described above in detail in connection with the specific embodiment, it will be apparent to those skilled in the art that various changes or modifications may be made thereto without departing from the spirit or scope of the invention.

The present application is based on Japanese patent application (2007-171659), filed on Jun. 29, 2007, entire contents of which are incorporated herein by reference.

Industrial Applicability

The present invention is applicable to a gas combustion type driving tool for driving a fastener such as a nail or screw by including a cylinder, a cylinder head and a movable sleeve.

The invention claimed is:

1. A gas combustion type driving tool comprising:

a cylinder slidably accommodating a piston;

a cylinder head provided above the cylinder;

a cylindrical movable sleeve disposed movably in a vertical direction between the cylinder and the cylinder head and having a larger inner diameter than an outer diameter of the cylinder; and an annular sliding portion formed on an outer circumference of the cylinder and below an upper opening end of the cylinder and sliding with an opening portion at a lower end of the movable sleeve, wherein the outer circumference of the cylinder has at least a first outer circumferential portion entirely disposed at a height position below where the lower most outer circumference of the piston meets the inner circumference of the cylinder when the piston is at the top dead center, and a second outer circumferential portion located below the first outer circumferential portion, the second outer circumferential portion defined by a raised protrusion, the sliding portion is provided on the second outer circumferential portion, the outermost diameter of the second outer circumferential portion is larger than the outermost diameter of the first outer circumferential portion, and the cylindrical movable sleeve forms a combustion chamber above the upper opening end of the cylinder and around an outer periphery of the cylinder below the upper opening end of the cylinder and extending to the second outer circumferential portion.

2. The gas combustion type driving tool according to claim 1, further comprising:

a cylindrical partition wall portion provided on an extension from an upper end of the cylinder; and an opening portion formed on each of an upper part and a lower part of the partition wall portion.

3. The gas combustion type driving tool according to claim 1, further comprising:

a lower O-ring provided on an internal circumference of the opening portion at the lower end of the movable sleeve and capable of sliding with the sliding portion, wherein the lower O-ring is always located below a top dead center of the piston even if the movable sleeve is located at any position during normal use.

4. The gas combustion type driving tool according to claim 1, wherein the outer circumference of the cylinder further comprises a third outer circumferential portion located below the second outer circumferential portion, and the outer diameter of the second outer circumferential portion is larger than an outer diameter of the third outer circumferential portion.

5. The gas combustion type driving tool according to claim 1, wherein the sliding portion is located at a height position between a bottom dead center and a top dead center of the piston and below the top dead center by 20% or more of a total length of stroke between the bottom dead center and the top dead center.

* * * * *